United States Patent [19]

McGourty

[11] 4,027,508

[45] June 7, 1977

[54] PUSH-BUTTON COMBINATION LOCK

[76] Inventor: Thomas K. McGourty, 1640 Cox Road, Aptos, Calif. 95003

[22] Filed: Nov. 20, 1975

[21] Appl. No.: 633,638

[52] U.S. Cl. ..... 70/214; 70/306; 70/313; 70/316

[51] Int. Cl.[2] ..... E05B 37/02; E05B 37/16

[58] Field of Search ..... 70/214, 220, 301, 302, 70/303 R, 303 A, 304, 305, 306, 307, 308, 309, 310, 311, 312, 313, 315, 316, 317, 318

[56] References Cited

UNITED STATES PATENTS

| | | | |
|---|---|---|---|
| 215,229 | 5/1879 | Lewis | 70/306 |
| 615,886 | 12/1898 | Ormond | 70/306 |
| 1,374,749 | 4/1921 | McCarthy | 70/306 |
| 1,452,503 | 4/1923 | Grubb | 70/306 |
| 1,483,993 | 2/1924 | Sprowles et al. | 70/306 |
| 1,771,080 | 7/1930 | Fitzsimmons | 70/306 |
| 2,165,674 | 7/1939 | Pelle | 70/306 X |
| 2,580,830 | 1/1952 | Pelle | 70/306 X |
| 3,040,556 | 6/1962 | Rosenhagen | 70/306 X |
| 3,616,667 | 11/1971 | McGourty | 70/323 |
| 3,667,261 | 6/1972 | McGourty | 70/214 X |

*Primary Examiner*—Roy D. Frazier
*Assistant Examiner*—Thomas J. Holko
*Attorney, Agent, or Firm*—Fred N. Schwend

[57] ABSTRACT

A push-button combination lock for doors or the like having buttons which must be pushed in a prescribed combination and prescribed number of times to release the lock. The lock may be reset to a new combination by use of the same pushbuttons when operated in accordance with the newly desired combination. No tools or dismantling of the lock is required to change the combination. A bypass feature enables one to bypass the lock from the inside of the door.

14 Claims, 18 Drawing Figures

FIG. 2.
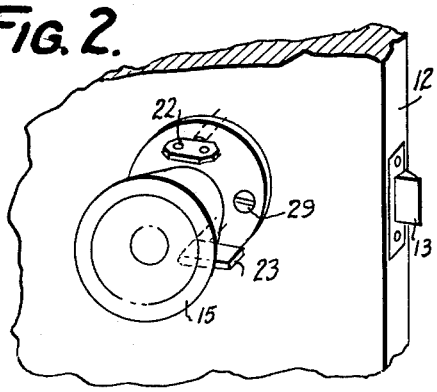
FIG. 1.
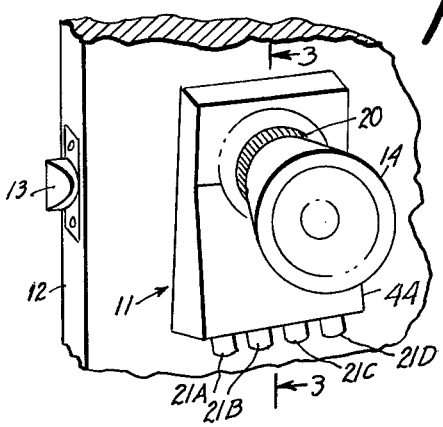
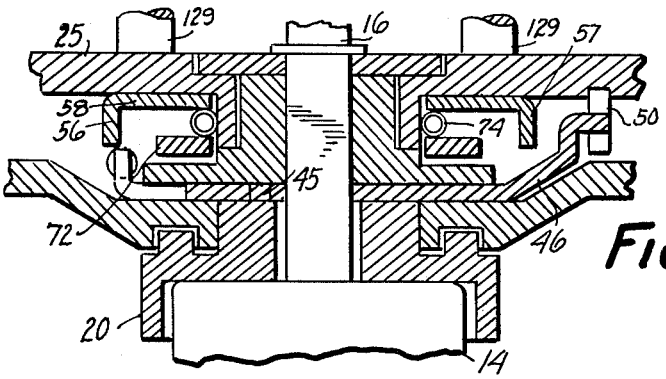
FIG. 7.
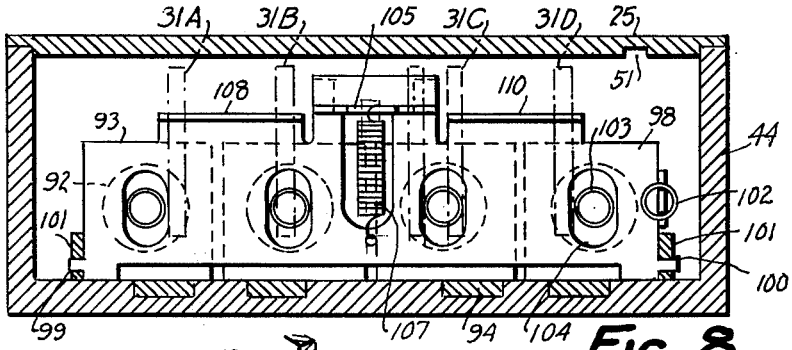
FIG. 8.
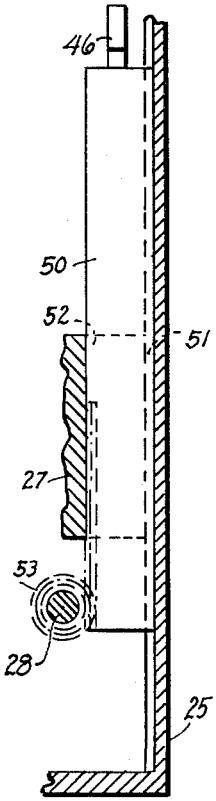
FIG. 10.
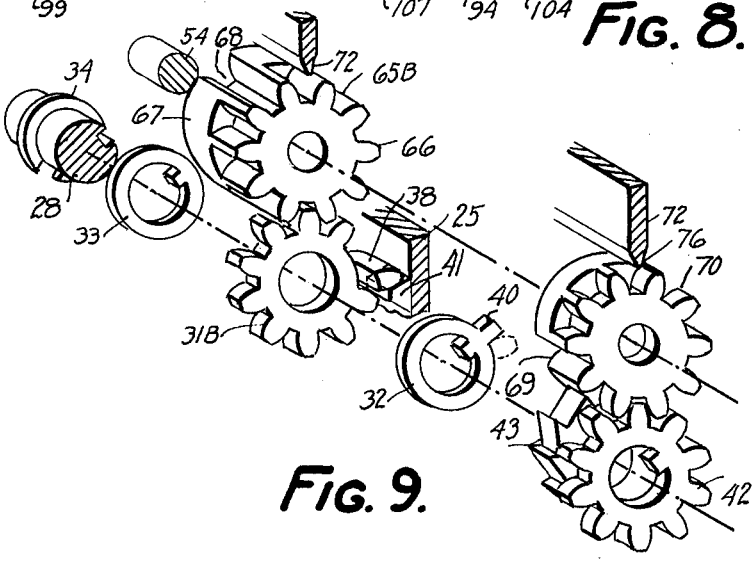
FIG. 9.

FIG. 3.
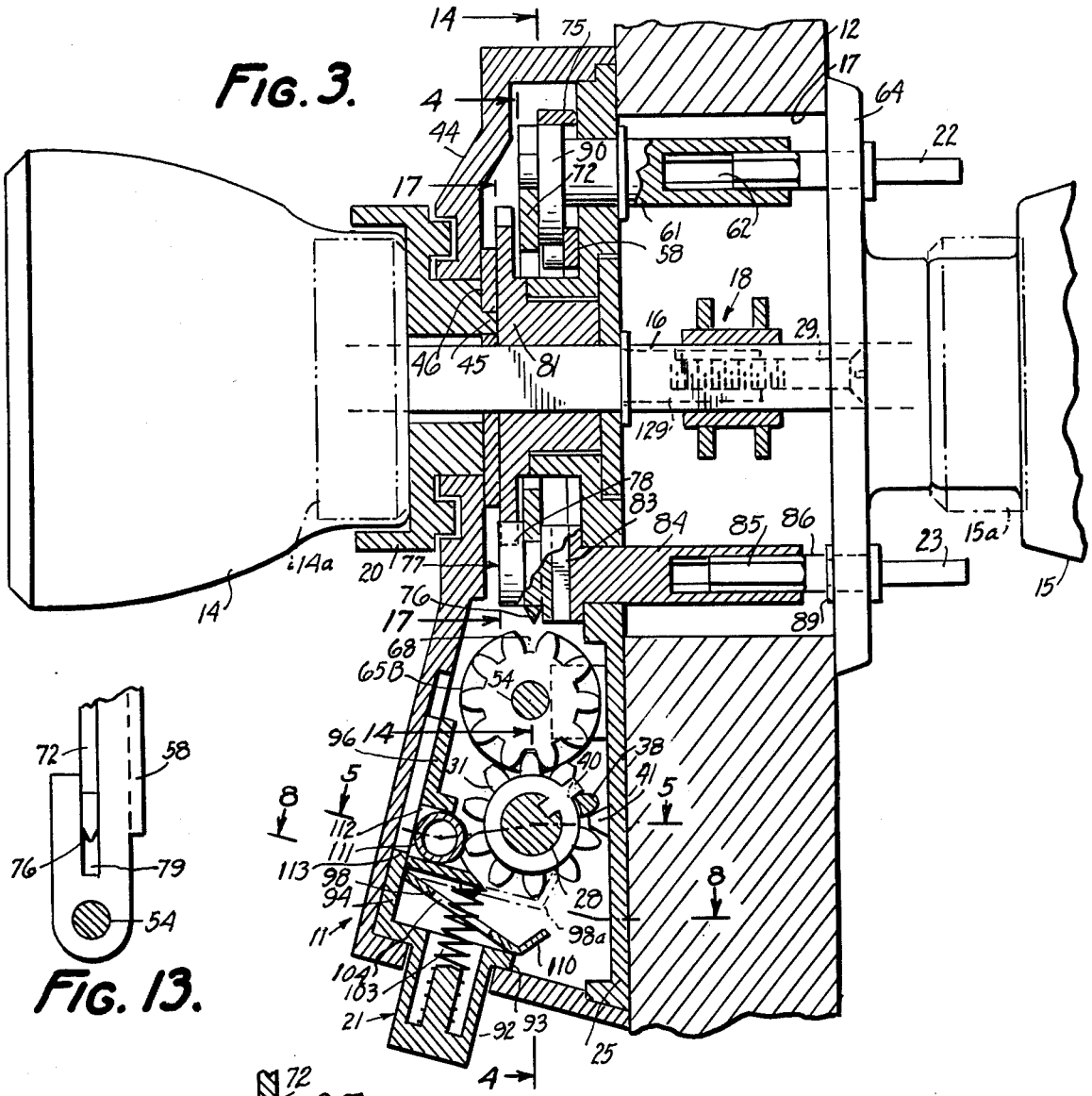
FIG. 13.
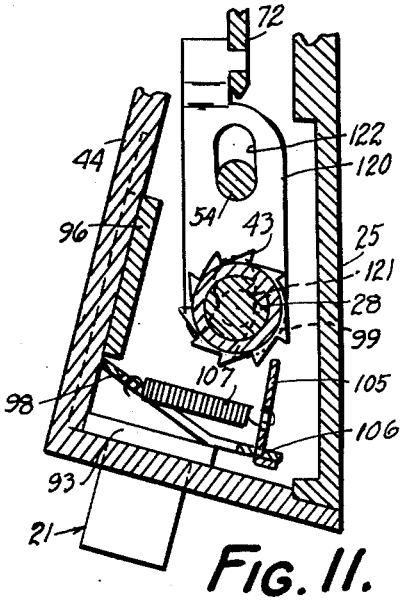
FIG. 11.
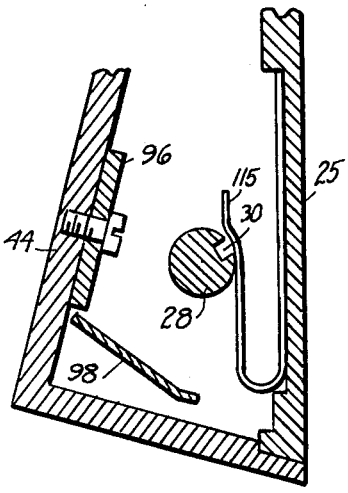
FIG. 12.

PUSH-BUTTON COMBINATION LOCK

BACKGROUND OF THE INVENTION

1. Field of the Invention

This invention relates to combination locks and has particular reference to push-button combination locks for use in locking and unlocking doors and the like.

2. Description of the Prior Art

The present invention presents several improvements over the push-button locks disclosed and claimed in my prior U.S. Pat. No. 3,616,667 issued on Nov. 2, 1971 and U.S. Pat. No. 3,667,261 issued on June 2, 1972.

The invention, in its broader aspects, can be used for any locking application although it is particularly aplicable to locking doors in cases where it may be desirable to change the combination from time to time. For example, hotel and apartment owners may wish to change the combination each time a new tenent moves into a living unit. Car rental agencies may wish to change the combination of car locks, each time one of their cars is rented, etc. Other examples are offices, factories, schools and other establishments where personnel changes occur from time to time; also lockers, safes, etc., where persons assigned custody thereof may be changed periodically.

SUMMARY OF THE INVENTION

A principal object of the present invention is to provide a push-button combination lock having a larger number of possible combinations and permutations.

Another object of the invention is to provide a lock of the above type in which said combinations can be readily changed without tools or without dismantling the lock.

Another object of the invention is to provide a lock of the above type which requires, as part of the combination, that the push buttons be pressed a prescribed number of times.

Another object is to provide a lock of the above type which as an optional feature, can be readily bypassed by the owner or authorized person whenever desired, even though the lock is in locked condition.

Another object is to provide a lock of the above type which may be installed on an existing door without reworking the door or changing an existing latch, door hinges, etc.

A further object is to provide a lock of the above type which is relatively simple, compact and inexpensive to manufacture.

According to the present invention, a plurality, preferably five, notched locking disk members are provided which can be set, either alone or in combination, to different positions each, resulting in an extremely large number of possible combinations and requiring a prescribed number of button depressions to effect release.

Further, when applied to a door latch, the lock of the present invention can be selectively bypassed by the owner or authorized person from the interior side of the door.

In addition, the lock is of compact construction and is mountable on the exterior side of the door so that it can be mounted in the existing standard cut-out by removing the conventional knob passage lock set and attaching the new assembly without any alterations to the door.

The lock can also be removed from the door and replaced with the conventional lock set.

The combination required to open the lock may be selected according to any desired single element code or multiple element code or combination of both, and also a predetermined number of successive button depressions, either singly or in combination, is required. For example, typical codes may be A, C, C, B or AB, CA, BD or AD, D, ABCD, BC, BC.

The manner in which the above and other objects of the invention are accomplished will be readily understood on reference to the following specification when read in conjunction with the accompanying drawings.

BRIEF DESCRIPTION OF THE DRAWINGS

FIG. 1 is a perspective view of a portion of a door, illustrating the exterior side with a push-button lock embodying a preferred form of the present invention.

FIG. 2 is a prespective view of the door illustrating the interior side thereof and including the lock of the present invention.

FIG. 3 is a transverse sectional view taken substantially along the line 3—3 of FIGS. 1 and 4.

FIG. 7 is a sectional plan view taken along line 7—7 of FIG. 4.

FIG. 8 is a sectional plan view taken along the line 8—8 of FIG. 3.

FIG. 9 is an exploded view illustrating the indexing gear and associated locking disk elements, along with one of the setting gears and its associated locking disk element.

FIG. 10 is a sectional view taken along the line 10—10 of FIG. 4, illustrating part of the reset mechanism.

FIG. 11 is a sectional view taken substantially along the line 11—11 of FIG. 4 illustrating the pawl device for incrementally advancing the indexing ratchet.

FIG. 12 is a sectional view taken along the line 12—12 of FIG. 5 illustrating the friction drag for the setting gear shaft.

FIG. 13 is a fragmentary sectional view taken along the line 13—13 of FIG. 4.

DESCRIPTION OF THE PREFERRED EMBODIMENT

Figure 4:
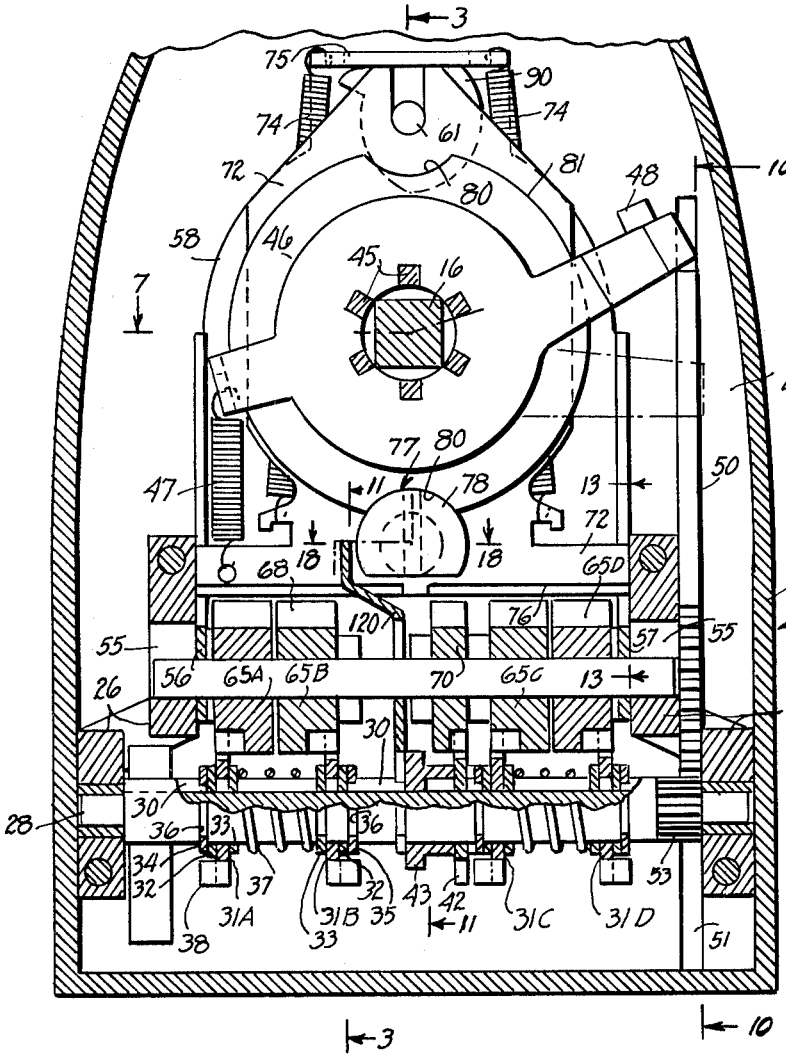
FIG. 4 is a sectional view taken substantially along the line 4—4 of FIG. 3.

In order to best understand the lock, the general construction and operation thereof will be first described. Referring to FIGS. 1 to 3, the lock, generally indicated at 11, is illustrated as mounted on a typical swinging door 12 having a conventional latch bolt 13, a conventional outside door knob 14 and a conventional inside door knob 15. The usual square shaft 16 is splined and suitably secured to both knobs 14 and 15 and extends through the usual round lock opening 17 of standard size in the door and is effective upon rotation of either knob and shaft 16 in either direction to operate a conventional bolt actuator device partly shown at 18 to retract the bolt. Obviously, handles or other actuators can be used in lieu of the door knobs 14 and 15.

In order to lock the door from being opened from either the inside or outside, a locking knob 20 adjacent door knob 14 is rocked clockwise. In order to release the lock, certain of a series of four push-buttons 21A, 21B, 21C, and 21D must be pressed in a predetermined combination and also a predetermined number of times. If the owner or an authorized person desires to bypass the lock, i.e. to open the door even though the lock is in locked condition, a bypass lever 23 on the inside of the door is rocked 180°, permitting the knobs 14 and 15 to be rotated to withdraw the bolt 13.

If it is desired to change the combination and number of times the buttons 21A and 21D must be depressed, the lock is first released, using the old combination, and a reset key 22 is inserted into the lock from the inside of the door and is rocked approximately 120°. The locking knob 20 is then rocked clockwise and thereafter the new combination is entered by means of the puch-buttons 21A to 21D. Then, the reset key is returned to its original position and removed, and the locking knob 20 is again rocked clockwise to lock the door. The push-buttons will thereafter have to be actuated in accordance with the new combination in order to again release the lock.

Describing now the lock in detail, a lock base 25 is secured against the exterior side of the door 12, preferably by screws 29 extending through a bezel plate 64 fitted against the interior side of the door. The screws pass through lock opening 17 and are threaded into studs 129 (see also FIG. 7) extending from the base 25. The base 25 has spaced bearing brackets 26 and 27, FIGS. 4 and 5, integral therewith, in which there is journalled a setting shaft 28 having a keyway 30 therein. Spaced setting gears 31A, 31B, 31C and 31D are rotatably mounted on the shaft 28 and are frictionally connected thereto so as to normally turn therewith. For this purpose, each gear is interposed between a normalizing disk 32 (see also FIGS. 3, 4, 5 and 9) and a friction disk 33, both slideably keyed on shaft 28. In turn, each pair of normalizing disks 32 is interposed between clips 34 and 35 secured in circumferential grooves 36 formed in the shaft. A compression spring 37 is fitted over shaft 28 and is interposed between each pair of friction disks 33 to yieldably clutch the setting gears 31A, etc., to the shaft 28.

Figure 5:
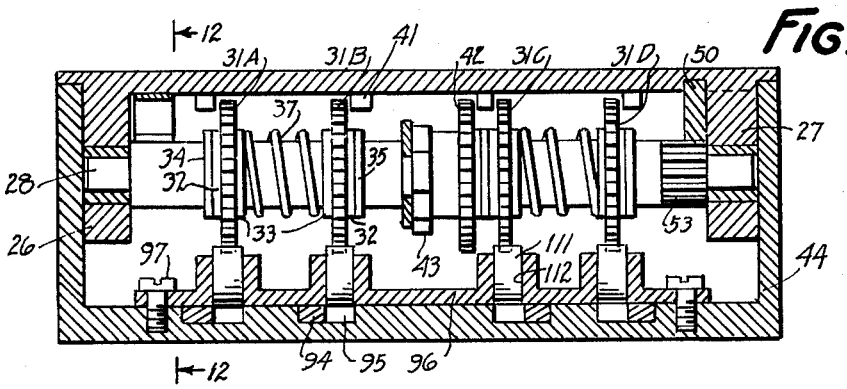
FIG. 5 is a sectional plan view taken along the line 5—5 of FIG. 3.

Each of the gears 31 has ten teeth thereon and one of such teeth. i.e. 38, is extended laterally to overlap a tooth 40 extending outwardly from the adjacent normalizing disk 32. Also, the laterally extending portion of the gear tooth 38 is engageable with a stop tooth 41 formed on the lock base 25, as best seen in FIGS. 3, 5 and 9.

An indexing gear 42 and an indexing ratchet wheel 43 are keyed on the shaft 28 intermediate the setting gears 31B and 31C, the purpose of which will be described later.

The aforementioned locking knob 20 is journalled in a bearing formed in a lock cover 44 which is suitably secured to the lock base 25 and is rockable independently of the knob 14 and shaft 16. Such knob 20 is integrally connected by tongues 45 (see also FIG. 4) to a restore arm 46 normally held in its illustrated position against a stop 48 on the base 25 by tension spring 47. Upon clockwise rocking of the knob 20, the arm 46 depresses a gear rack 50, FIGS. 4, 7 and 10, slideably mounted in guide slots 51 and 52 formed in the lock base 25 and bracket 27 respectively. Rack 50 meshes with a pinion 53 formed on the setting shaft 28. Thus, depression of the rack 50 by means of knob 20 rotates the shaft 28 clockwise as viewed in FIGS. 3, 9 and 10, causing setting gears 31 to likewise rotate until the laterally extending teeth 38 are arrested by the stop teeth 41. Teeth 40 on the normalizing disks 32 finally engage such teth 38 to insure that such teeth come to rest in initial positions as seen in FIGS. 3 and 9.

A shaft 54 is mounted at its ends in vertically elongated guide slots 55 formed in the brackets 26 and 27 and is carried by side flanges 56 and 57 formed on opposite edges of a reset slide 58 (FIGS. 4, 7, 13, 14 and 15). The latter is slideable vertically between the brackets 26 and 27 and has a vertical slot 60 at its upper end slideably embracing a reset shaft 61, FIG. 3, which is journalled in a bearing formed in the lock base 25 and is splined at 62 to form a keyway into which the reset key 22 can be inserted when it is desired to change the combination.

Notched locking disk elements 65A, 65B, 65C and 65D are independently rotatable on the shaft 54. Each locking element comprises a ten toothed gear section 66 and a disk portion 67 having a single notch 68 formed therein and coextensive with a gear tooth space in the gear section 66.

Figure 14:
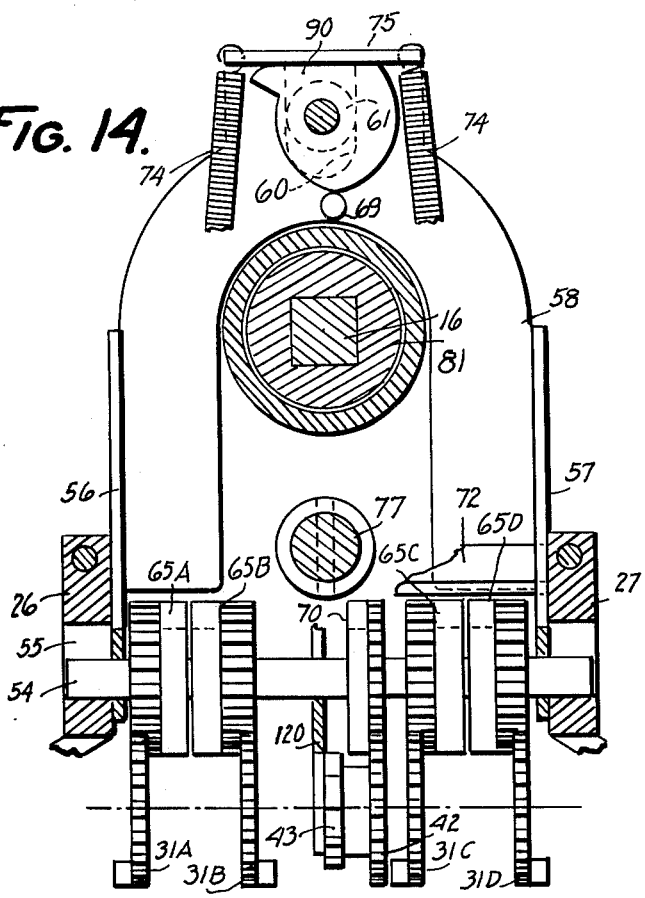
FIG. 14 is a sectional view taken substantially along the line 14—14 of FIG. 3 illustrating the reset slide and locking disk elements in normal positions.
Figure 16:
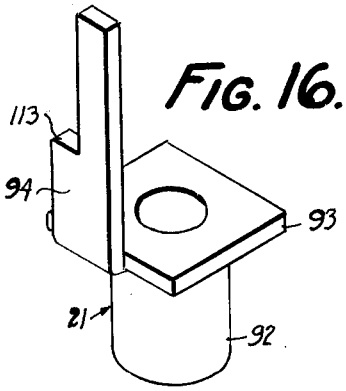
FIG. 16 is a perspective view of a typical push-button.

When the reset slide 58 is in its normal lowered position shown in FIGS. 3, 4 and 14, the gear section 66 of such locking element 65 meshes with the correspondingly lettered setting gear 31. Also, an additional notched locking disk element 70, similar to the locking elements 65, and rotatable on the shaft 54, normally meshes with the indexing gear 42. Such element 70 also has a disk portion having a single notch 69 therein coextensive with a gear tooth space on the gear portion of such element.

Figure 17:
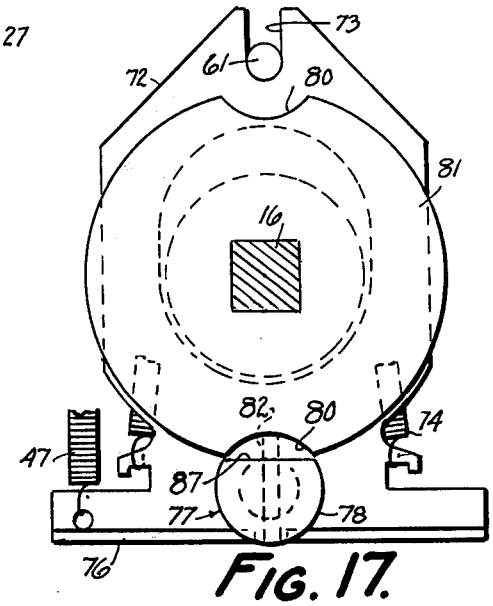
FIG. 17 is a view taken along the line 17—17 of FIG. 3, illustrating the sensing slide interponent in lock bypassing position.

A sensing slide 72, FIGS. 4, 7 and 17, forming part of the lock device, is slideable vertically between the brackets 26 and 27 and has an upper vertical slot 73 slideably embracing the reduced forward end of the reset shaft 61. Slide 72 is normally held in its illustrated raised position by a pair of tension springs 74 extending between the slide and a cross-flange 75 formed on the upper end of the reset slide 58.

Sensing slide 72 has a tapered lower edge 76 adapted to fit within the notches 68 of the various locking disk elements 65 and 70 when such notches are aligned with the slide, as seen in FIG. 3. The outer lower portions of the slide 72 are guided vertically in slots 79 formed in the flanges of the reset slide 58 as seen in FIG. 13.

An interponent member 77, FIGS. 3, 4, 17 and 18, is rotatably mounted in a bearing formed in the lower end of the sensing slide 72 and has a D-shaped head 78 normally located in its set position shown in FIG. 4 and engaging in one of two diametrically opposed notches 80 formed in a locking disk 81 which is splined on the square shaft 16. The rear end of the interponent member 77 is enlarged to retain it on the sensing slide and has a normally vertically extending slot 82 formed therein and slideably engaged by a tongue 83 formed on a shaft 84 which is rotatably mounted in a bearing formed in the lock base 25 and is splined at 85 to the shaft 86 of the aforementioned bypass lever 23. Lever 23 is retained in splined connection to the shaft 84 by a retaining clip 89.

From the above it will be seen that with the interponent member 77 in its rocked position illustrated in FIG. 4, rotation of the door knobs 14 and 15 will cause the locking cam 81 to cam against the head 78 of interponent 77 to lower the sensing slide 72 into either blocked relation with the periphery of one or more of the locking elements 65A to 65D and 70 or into aligned notches 68, 69 therein, in which case the door knobs will be allowed to rock sufficiently to retract the bolt 13.

In the event it is desired to bypass the lock 11 to premit opening of the door by the knobs 14, 15 even though the lock is in its locked condition, the bypass lever 23 is rotated 180°, as noted previously, thereby likewise rotating the interponent member 77 to present the flat edge 87 thereof to the locking cam 81, as depicted in FIG. 17, so that the shaft 16 may be rotated without depressing or attempting to depress the sensing slide 72.

Figure 15:
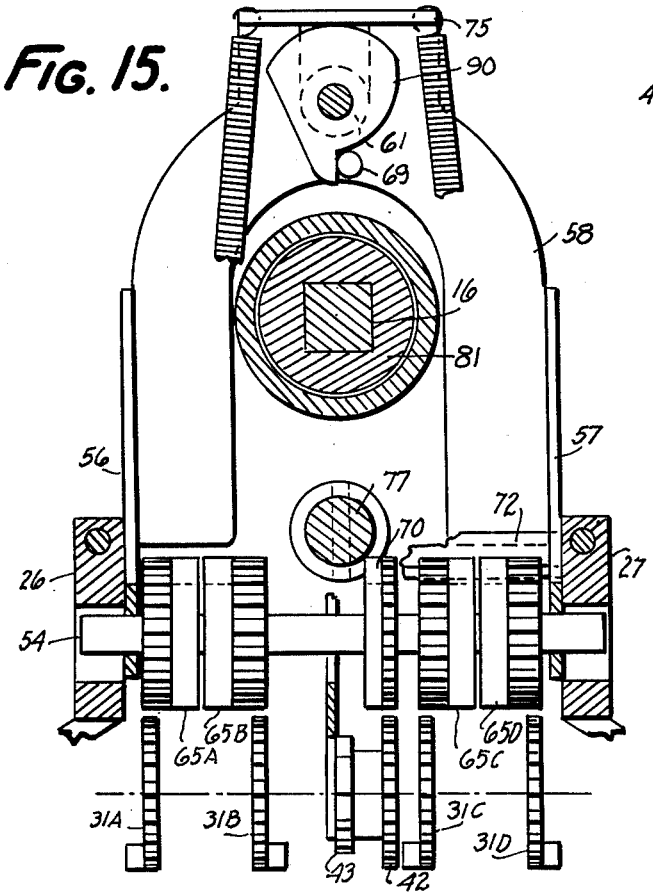
FIG. 15 is a sectional view similar to FIG. 14 but illustrating the reset slide and locking disk elements in their alternate positions.
Figure 18:
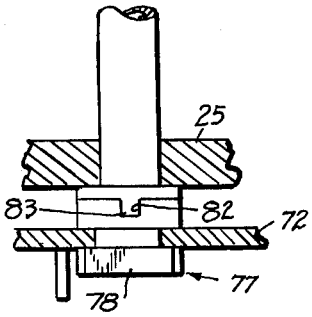
FIG. 18 is a sectional plan view taken along the line 18—18 of FIG. 4, illustrating the sensing interponent and its rotating means.

Means are provided to raise the reset slide 58 and thus the locking elements 65 and 70 out of mesh with the setting gears 31 and indexing gear 42, and into interlocking engagement with the normally raised sensing slide 72, as seen in FIG. 15, for the purpose of changing the combination of the lock, as will be described later. For this purpose, reset shaft 61 is provided with a reset cam 90 engaging the flange 75 of reset slide 58. Thus, when the reset shaft 61 is rocked by the inserted key 22 from its position shown in FIG. 14 to that shown in FIG. 15, the cam 90 will raise the reset slide 58, moving the locking elements 65 and 70 into their upper illustrated position of FIG. 15, providing their notches 68 and 69 are aligned with slide 72, thereby preventing inadvertent rotation of the locking elements and permitting independent rotation of the various setting gears 31A to 31D and indexing gear 42 to their initial positions as will be described later.

Referring now to FIGS. 3, 5, 8, 11 and 16, the pushbuttons 21A to 21D are substantially alike and each comprises a cylindrical button 92 extending through an opening in the lock cover 44. A square base 93 at the top of the button 92 is formed integral with an offset stem 94 slideable vertically in a corresponding slot 95 formed in the lock cover 44 and is retained in the slot by a retainer plate 96 secured to the lock cover by screws 97. A bail 98 is pivotally mounted at 99 and 100, FIG. 8, formed in brackets 101 extending from the retainer plate 96. The bail is urged downward by a compression spring 102 against the bases 93 of the various buttons. Compression springs 103 extend between the retainer plate 96 and the various buttons 21 and through openings 104 in the bail 98 to normally hold the buttons in their lower positions.

A pawl 105, FIGS. 8 and 11, is pivoted at 106 to the central portion of the bail 98 and is normally held in its position shown relative to the bail by a spring 107 tensioned between the pawl and the bail. The pawl 105 underlies the ratchet wheel 43 only so that whenever any button or combination of buttons 21 is pressed upwardly, the bail 98 will be rocked upwardly to its dot and dash line position 98*a* in FIG. 3, causing the pawl 105 to advance the ratchet wheel 43 and setting gears 31 on shaft 28 one increment or tooth space. This is equal to one tooth space of each of the locking disk elements 65A to 65D and 70.

As each setting gear 31, which is otherwise allowed to rotate, is advanced to a new incremental position by incremental rotation of the shaft 28, it is engaged and centralized by one or two centralizing ledges 108 and 110 formed on the bail 98.

Means are provided to prevent incremental rotation of that setting gear 31 whose associated button 21 is being actuated. For this purpose, detent rolls 111, FIGS. 3 and 5, are aligned with respective ones of the setting gears 31 and are guided for rolling movement against such gears in guide openings 112 formed in the retainer plate 96. Each button stem 94 is cut out to form a shoulder 113, FIG. 16, normally lying below the level of its detent roll 111. Thus, when a setting gear 33 is rotated by depression of a key not associated therewith, the roll 111 merely rolls back and forth in its guide opening 112. However, as each button is actuated, the shoulder 113 of its stem will move upwardly past its roll 111 prior to actuation of the ratchet wheel 43 by pawl 105, thus causing such roll to block the aligned setting gear 33 from rotating.

As seen in FIG. 12, a friction spring 115 engages the setting shaft 28 and is anchored at its ends by the lock base 25 to prevent overthrow or free rotation of the shaft and gears thereon when reset slide 58 disengages the two sets of gears when entering a new combination order.

Describing now the operation of the lock, an example will be given wherein the sequence of depression of different combinations of the buttons required to release the lock is expressed by the following:

BC
BC
CD

Figure 6:
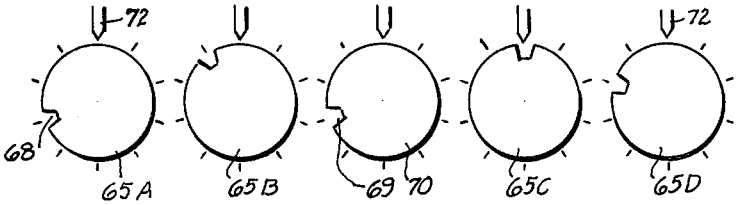
FIG. 6 is a schematic view illustrating a typical setting of the notched locking disk members.

In such case, and considering the locking knob 20 to have been rocked to move the setting shaft 28 and various gears 31, 42 along with the ratchet wheel 43, into their initial positions shown in FIGS. 3 and 9, the notched locking disk elements 65 and 70 will assume their locking positions shown schematically in FIG. 6. That is, the notch 68 of locking element 65A is located three increments counterclockwise from its releasing position, the notch of element 65B is one increment from its releasing position, the notch of element 65C is at its releasing position and the notch of element 65 D is two increments from its releasing position while the notch of element 70 is three increments from its releasing position. Thus, when one actuates the buttons 21B and 21C, elements 65B and 65C will remain as shown and elements 65A and 65D will advance one increment, along with element 70. Now, if he again actuates buttons 21B and 21C, elements 65A, 65D and 70 will again advance one increment, in which case element 65D will arrive at its releasing position. When he further actuates buttons 21C and 21D, elements 65A, 65B and 70 will further advance one increment each, leaving all locking elements in releasing position, permitting the sensing slide 72 to be moved downwardly by locking cam 81 so that the door knobs may be rocked sufficiently to retract the lock bolt 13.

If the owner or authorized person wishes to change the combination, he first enters the proper old combination to properly align the notches of the locking elements 65A to 65D and 70. He inserts the reset key 22 and rocks the same to raise the locking elements 65 and 70 into their upper positions shown in FIG. 15 to engage sensing slide 72 and demesh such elements from the setting gears 31. He then rotates the locking knob 20 clockwise to return the setting gears to their initial positions of FIGS. 3 and 9. Thereafter, he actuates the buttons 21A to 21D according to the newly desired combination and later returns the reset key 23 from its rocked position. During this movement, the cam 90 engages a stud 69 on slide 58 to lower the same, returning the locking elements into their normal positions in mesh with the setting gears 31 which have a new combination set therein. Thereafter, he again rotates the locking knob 20 clockwise to enter the new combination in the locking elements 65A, etc., and 70, thereby setting the lock.

Means are provided to prevent attempts to actuate the setting gears 31 by depressing the push buttons 21 when the lock is in opened position, causing possible damage. For this purpose, a camming link 120, FIGS. 4 and 11, is coupled to the sensing slide 72 and has elongated slots 121 and 122 therein slideably embracing the shafts 28 and 54, respectively. When the slide 72 is lowered upon turning of the knobs 14, 15, a curved edge 99 of the link will cam the pawl 105 outward to prevent indexing of the ratchet wheel 43 by depression of one or more of the push buttons.

An important feature of the lock of the present invention is that it can be mounted on a door having a conventional latch bolt, actuator, door knobs and door knob shaft. In such case, the door knobs and standard bezel plates are first removed. The lock 11 and bezel plate 64 are then installed and clamped in place by the screws 29. Thereafter, door knobs are added. Thus, no additional holes or reworking of the door is required.

It will be obvious to those skilled in the art that many variations may be made in the exact structure shown without departing from the spirit of this invention. For example, the latch bolt 23 may be replaced by a conventional dead bolt, in which case the door knobs 14 and 15 are preferably replaced by smaller actuators, shown by dot-dash lines **14*a* and 15*a* which are suitably attached to the shaft 16.** Also, a greater or less number of push buttons and corresponding setting gears and locking elements can be provided. However, I have found that the above described construction utilizing four push buttons is entirely satisfactory for most cases.

I claim:

1. A combination lock comprising a locking device movable from a first position to a second position, a plurality of rotatable locking elements in the path of said device, each of said elements having a notch therein for permitting movement of said device to said second position when all said notches are in predetermined positions, a plurality of push buttons for corresponding ones of said locking elements, setting means operable by each of said push buttons upon actuation thereof for incrementally rotating all of said elements except the said element corresponding to the actuated push button, an additional rotatable locking element in the path of said device, said additional element having a notch therein for permitting movement of said device to said second position when said last mentioned notch is in a predetermined position, and means operable by each of said push buttons upon actuation thereof for invariably incrementally rotating said additional element.

2. A combination lock as defined in claim 1 comprising means for initially rotating all of said locking elements to selectively different positions.

3. A combination lock as defined in claim 1 wherein said locking elements comprise coaxially extending first gears, and said setting means comprise coaxially extending setting gears in mesh with respective ones of said first gears, and means for selectively moving said locking elements from mesh with said setting gears whereby the combination of said lock may be changed by rotating said setting gears relative to said first gears.

4. A combination lock as defined in claim 3 wherein said selective moving means is effective to move said locking elements radially to positions wherein said locking device extends into said notches.

5. A combination lock as defined in claim 1 comprising means for selectively rendering said locking device effective or ineffective to be controlled by said locking elements.

6. A combination lock as defined in claim 1 wherein said locking device comprises a first member movable from a first position to a second position, a sensing member engageable with said locking elements, and an interponent for transferring movement from said first member to said sensing member; and means for selectively rendering said interponent operable or inoperable.

7. A combination lock as defined in claim 1 wherein said setting means comprises coaxially extending setting gears and said locking elements comprise coaxially extending locking element gears intermediate said setting gears and said locking device, and a means for selectively moving said locking elements radially between first positions wherein said locking element gears are in mesh with said setting gears and second positions wherein said locking device extends into said notches when said notches are in said predetermined positions.

8. A combination lock as defined in claim 1 comprising a door latch locking device including a rotatable actuator, a cam operable by said actuator, an interponent carried by said locking device and operable by said cam, and means for selectively locating said interponent in and out of the path of said cam.

9. A combination lock as defined in claim 1 wherein said setting means comprises a ratchet, means connecting said ratchet to said additional locking element, means operable by each of said push-buttons for actuating said ratchet, and means operable by each of said push-buttons for preventing rotation of a corresponding one only of said locking elements.

10. A combination lock comprising a locking device including a sensing slide movable from a first position to a second position, a plurality of coaxially extending rotatable locking elements in the path of said sensing slide, each of said elements having a first gear and having a notch therein for permitting movement of said slide to said second position when all said notches are aligned with said sensing slide, a plurality of push buttons for corresponding ones of said locking elements, setting means including coaxially extending setting gears in mesh with said first gears, means operable by each of said push buttons upon actuation thereof for incrementally rotating all of said setting gears except the said setting gear corresponding to the actuated push button, an additional rotatable locking element in the path of said slide, said additional element having an additional first gear and having a notch therein for permitting movement of said slide to said second position when said last mentioned notch is aligned with said slide, an indexing gear in mesh with said additional first gear, means operable by each of said push buttons upon actuation thereof for invariably incrementally rotating said indexing gear, and means for selectively demeshing said first gears from said setting and indexing gears.

11. The combination as defined in claim 10 comprising means for concurrently setting said setting and indexing gears in initial positions.

12. The combination as defined in claim 10 comprising means for preventing operation of said setting gear rotating means upon movement of said slide to said second position.

13. A combination lock for attachment to a door having a rockable shaft, means including a bolt retractable by said shaft upon rocking thereof, and a manually operable actuator attached to said shaft on one side of said door, comprising a locking device connectable to said shaft intermediate said actuator and said door, said device being movable from a first position to a second position by rocking said shaft to retract said bolt, a plurality of rotatable locking elements in the path of said device, each of said elements having a notch therein for permitting movement of said device to said second position when all said notches are in a predetermined position, a plurality of push buttons, setting means operable by each of said push buttons upon actuation thereof for incrementally rotating all of said locking elements except the said locking element corresponding to the actuator push button, an additional rotatable locking element in the path of said device, said additional element having a notch therein for permitting movement of said device to said second position when said last mentioned notch is in a predetermined position, and means operable by each of said push buttons upon actuation of for invariably incrementally rotating said additional element.

14. A combination lock comprising a plurality of coaxially extending rotatable locking elements, a locking device including a sensing slide movable from a first position to a second position radially of said locking elements, each of said elements having a first gear and having a notch therein for permitting movement of said slide to said second position when all said notches are aligned with said sensing slide, a plurality of push buttons for corresponding ones of said locking elements, setting means including coaxially extending setting gears in mesh with said first gears, means operable by each of said push buttons upon actuation thereof for incrementally rotating all of said setting gears except the said setting gear corresponding to the actuated push button, an additional rotatable locking element coaxial with said first mentioned locking elements, said additional element having an additional first gear and having a notch therein for permitting movement of said slide to said second position when said last mentioned notch is aligned with said slide, an indexing gear in mesh with said additional first gear, means operable by each of said push buttons upon actuation thereof for invariably incrementally rotating said indexing gear, and means for selectively demeshing said first gears radially from said setting and indexing gears.

* * * * *